US010858170B2

(12) United States Patent
Eng et al.

(10) Patent No.: US 10,858,170 B2
(45) Date of Patent: Dec. 8, 2020

(54) DUAL DISPENSING COSMETIC CONTAINER

(71) Applicant: HCT GROUP HOLDINGS LIMITED, Sheung Wan (CN)

(72) Inventors: Nolan Quentin Eng, Foothill Ranch, CA (US); Adrian Apodaca, Daly City, CA (US)

(73) Assignee: HCT GROUP HOLDINGS LIMITED, Hong Kong (CN)

( * ) Notice: Subject to any disclaimer, the term of this patent is extended or adjusted under 35 U.S.C. 154(b) by 0 days.

(21) Appl. No.: 16/579,607

(22) Filed: Sep. 23, 2019

(65) Prior Publication Data

US 2020/0102138 A1 Apr. 2, 2020

Related U.S. Application Data

(60) Provisional application No. 62/738,646, filed on Sep. 28, 2018.

(51) Int. Cl.

| | |
|---|---|
| ***B65D 81/32*** | (2006.01) |
| ***B65D 47/20*** | (2006.01) |
| ***A45D 34/00*** | (2006.01) |

(52) U.S. Cl.

CPC ..... *B65D 81/3227* (2013.01); *A45D 34/00* (2013.01); *B65D 47/2093* (2013.01); *A45D 2200/054* (2013.01)

(58) Field of Classification Search

CPC ..... B65D 81/3227; B65D 47/2093; A45D 34/00; A45D 2200/054; A45D 2200/055; A45D 40/24; B05B 11/3059; B05B 11/3081; B05B 11/00442; B05B 11/0086; B05B 11/0078

See application file for complete search history.

(56) References Cited

U.S. PATENT DOCUMENTS

| | | | | |
|---|---|---|---|---|
| 2,438,906 A * | 4/1948 | Elsas | B65D 51/28 | 222/108 |
| 4,595,127 A * | 6/1986 | Stoody | B05B 7/2421 | 222/135 |
| 4,932,563 A * | 6/1990 | Diamond | A45F 3/16 | 222/129 |

(Continued)

FOREIGN PATENT DOCUMENTS

| | | |
|---|---|---|
| KR | 101363349 B1 | 2/2014 |
| KR | 1020180003933 A | 1/2018 |
| KR | 101876759 B1 | 7/2018 |

OTHER PUBLICATIONS

International Search Report and Written Opinion dated Jan. 20, 2020 for International Application No. PCT/US2019/052482.

*Primary Examiner* — David P Angwin
*Assistant Examiner* — Bob Zadeh
(74) *Attorney, Agent, or Firm* — Seager, Tufte & Wickhem LLP

(57) ABSTRACT

Cosmetic containers configured to hold and dispense a cosmetic product. The container may store and dispense cosmetic products from two different cavities, or it may be configured to dispense a cosmetic product from a single cavity in two different manners. A first dispensing outlet can be used by adjusting the container to a first configuration and tilting the container. A second dispending outlet is used by actuation of a pump.

20 Claims, 9 Drawing Sheets

(56) References Cited

U.S. PATENT DOCUMENTS

| | | | | |
|---|---|---|---|---|
| 6,010,034 | A * | 1/2000 | Walthers | A47G 19/2266 222/129 |
| 8,225,962 | B2 * | 7/2012 | Rossignol | B05B 15/30 222/137 |
| 8,281,957 | B2 * | 10/2012 | Farmer | A47K 5/14 222/146.5 |
| 2008/0277419 | A1 * | 11/2008 | Holcomb | A47G 19/183 222/129 |
| 2014/0361038 | A1 * | 12/2014 | Mekata | B65D 83/62 222/95 |
| 2016/0321294 | A1 | 11/2016 | Kim et al. | |
| 2017/0112331 | A1 * | 4/2017 | Toh | B05B 11/0097 |
| 2020/0102138 | A1 * | 4/2020 | Eng | B05B 11/3081 |

* cited by examiner

DUAL DISPENSING COSMETIC CONTAINER

RELATED APPLICATIONS

This application claims the benefit of and priority to U.S. Provisional Patent Application No. 62/738,646, filed on Sep. 28, 2018, titled DUAL DISPENSING COSMETIC CONTAINER, the disclosure of which is incorporated herein by reference.

TECHNOLOGY FIELD

The present application relates generally to cosmetic container, and in particular, to a container including a first cosmetic dispensing feature including a pump and a second cosmetic dispensing feature actuated via tilting the container.

BACKGROUND

Devices exist for dispensing cosmetic, medicinal, food, household, or other type products. Such devices usually consist of an outer housing, a delivery mechanism for dispensing the different types of products, and an applicator. For example, in various industries, devices are employed for dispensing powder, gel, creams, or lotions. In the cosmetics and personal care industries, devices are used to dispense lipstick, lip balm, skin creams, lotions, compact powder, loose powder, and other cosmetic products to portions of the face and body. However, there remains a need in the art for improved devices.

SUMMARY

This disclosure provides design, material, manufacturing methods, and use alternatives for cosmetic packaging.

In a first example, a cosmetic container may comprise an outer bottle defining a first cavity configured to receive a first cosmetic product, an inner bottle disposed within the first cavity of the outer bottle and defining a second cavity configured to receive a second cosmetic product, an outer neck coupled to a first end region of the outer bottle, an inner neck coupled to a first end region of the inner bottle, a rotatable dial defining a first dispensing outlet rotatably coupled to the outer neck, a pump actuator defining a second dispensing outlet and slidably disposed within a cap, the cap coupled to the rotatable dial, and a pump mechanism fluidly coupled to the second dispensing outlet and the second cavity. The rotatable dial may be movable between a first dispensing configuration and a second storage configuration to selectively fluidly couple the first cavity and the first dispensing outlet.

Alternatively or additionally to any of the examples above, in another example, actuation of the pump may dispense the second cosmetic product through the second dispensing outlet.

Alternatively or additionally to any of the examples above, in another example, when the rotatable dial is in the first dispensing configuration, the first cosmetic product may be pourable from the first dispensing outlet.

Alternatively or additionally to any of the examples above, in another example, the cosmetic container may further comprise a vent opening defined in the rotatable dial.

Alternatively or additionally to any of the examples above, in another example, when the rotatable dial is in the first dispensing configuration, the vent opening may be in fluid communication with the first cavity.

Alternatively or additionally to any of the examples above, in another example, the cosmetic container may further comprise a flexible gasket disposed within an annular cavity of the rotatable dial.

Alternatively or additionally to any of the examples above, in another example, the gasket may include a first channel configured to fluidly couple the first cavity with the first dispensing outlet.

Alternatively or additionally to any of the examples above, in another example, the gasket may include a second channel configured to fluidly couple the first cavity with the vent opening.

Alternatively or additionally to any of the examples above, in another example, when the rotatable dial is in the second storage configuration, the gasket may be configured to fluidly isolate the first dispensing outlet from the first cavity.

Alternatively or additionally to any of the examples above, in another example, the second dispensing outlet may comprise a cylindrical nozzle.

Alternatively or additionally to any of the examples above, in another example, the cylindrical nozzle may be axially slidable within a slot extending through a wall of the cap.

Alternatively or additionally to any of the examples above, in another example, the dial may further comprise a radially inward extending protrusion, the radially inward extending protrusion configured to engage a slot in the outer neck.

Alternatively or additionally to any of the examples above, in another example, the radially inwardly extending protrusion and the slot may be configured to limit a rotation range of motion of the rotatable dial.

Alternatively or additionally to any of the examples above, in another example, the range of motion may be in the range of about 45° to about 55°.

Alternatively or additionally to any of the examples above, in another example, the pump mechanism may be actuatable when the rotatable dial is in the first dispensing configuration and when the rotatable dial is in the second storage configuration.

Another illustrative, non-limiting example takes the form of a cosmetic container, comprising: a bottle defining a cavity configured to receive a cosmetic product; an outer neck coupled to a first end region of the bottle; a rotatable dial defining a first dispensing outlet rotatably coupled to the outer neck; a vent opening defined in the rotatable dial; a pump actuator defining a second dispensing outlet and slidably disposed within a cap, the cap coupled to the rotatable dial; and a pump mechanism fluidly coupled to the second dispensing outlet and the cavity; wherein the rotatable dial is movable between a first dispensing configuration and a second storage configuration to selectively fluidly couple the cavity and the first dispensing outlet; and wherein the pump mechanism is actuatable when the rotatable dial is in the first dispensing configuration and when the rotatable dial is in the second storage configuration.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION OF EXEMPLARY EMBODIMENTS

Generally, disclosed herein is a cosmetic container configured to store and dispense cosmetics from two different compartments. While the cosmetic container is described as including two different compartments, it is contemplated that a single compartment may be fluidly coupled to two different or separate dispensing outlets. In some embodiments, at least one of the cosmetics may have a viscosity that allows it to be flowable or pourable from a nozzle or opening.

Figure 1:
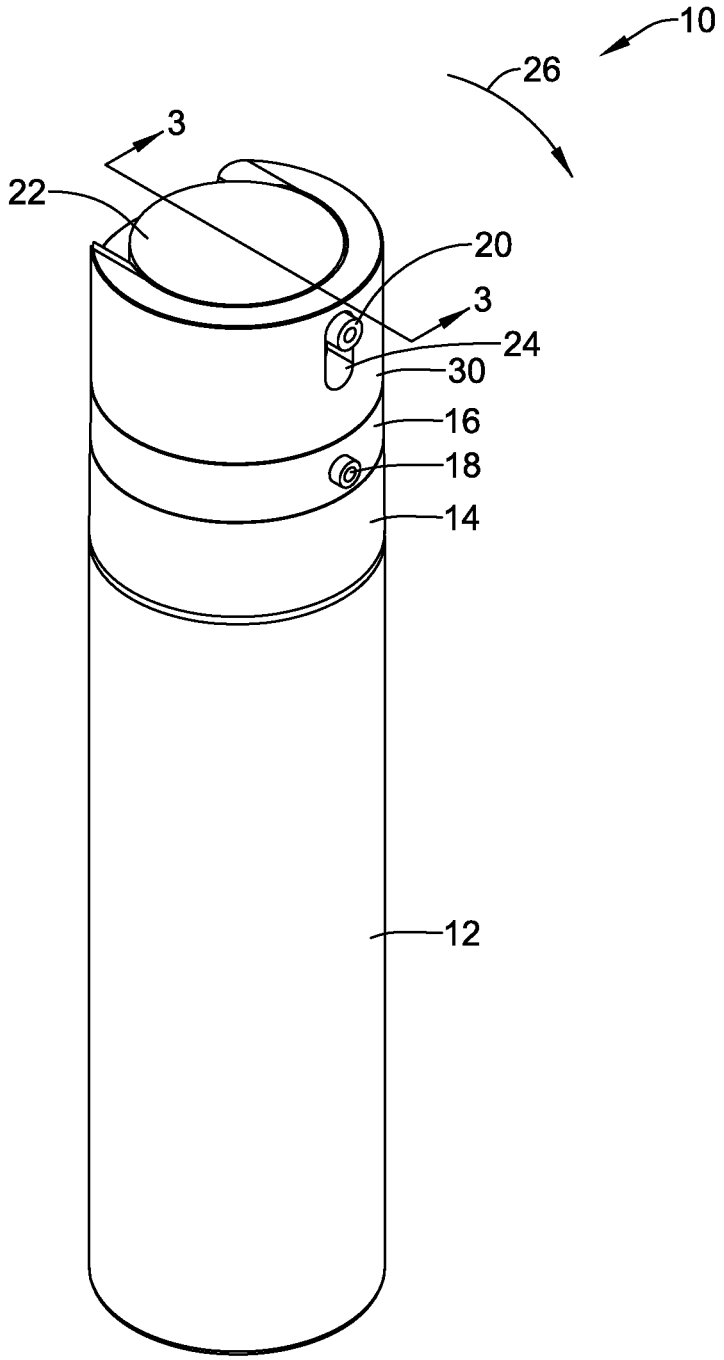
FIG. 1 is a front perspective view of an illustrative cosmetic container in a first dispensing configuration.

FIG. 1 is a front perspective view of a container 10 for dispensing at least two cosmetic products, such as two liquids. The container 10 includes an outer bottle 12, an outer neck 14, a rotatable dial 16 including a first dispensing outlet 18, a cap 30, and a pump actuator 22 including a second dispensing outlet 20. In the cosmetics and personal care industries, the cosmetic container 10 may be used to dispense liquid foundations, creams, lotions, oils, serums, lip gloss, etc. By way of example, and not limitation, the cosmetic container 10 can also be used in applications other than cosmetic devices. For example, the cosmetic container 10 may be implemented in medicinal products, cosmetics and personal care industries or other industries for applying a liquid or gel product.

The container 10 for dispensing a cosmetic product is shown in an elongated cylindrical configuration. However, it should be understood that examples of the disclosure described herein may be applied to various other configurations in other examples. For example, the container 10 may alternatively be embodied in an elongated square or polygonal configuration where the components of the device are all of such shapes. Other shapes include oval, triangular, heart shaped, etc.

While not explicitly shown, the cosmetic container 10 may include an optional removable lid releasably coupled to the outer neck 14 and/or outer bottle 12. The lid may be configured to prevent unintentional actuation of the pump actuator 22 during storage or transport of the cosmetic container 10. In some cases, the lid may include features (e.g., a protrusion) configured to form a snap fit with a mating groove or recess on the outer neck 14 and/or outer bottle 12. In other cases, the lid may be configured to threadably engage, form an interference fit with, or otherwise couple with the outer neck 14 and/or outer bottle 12.

Figure 2:
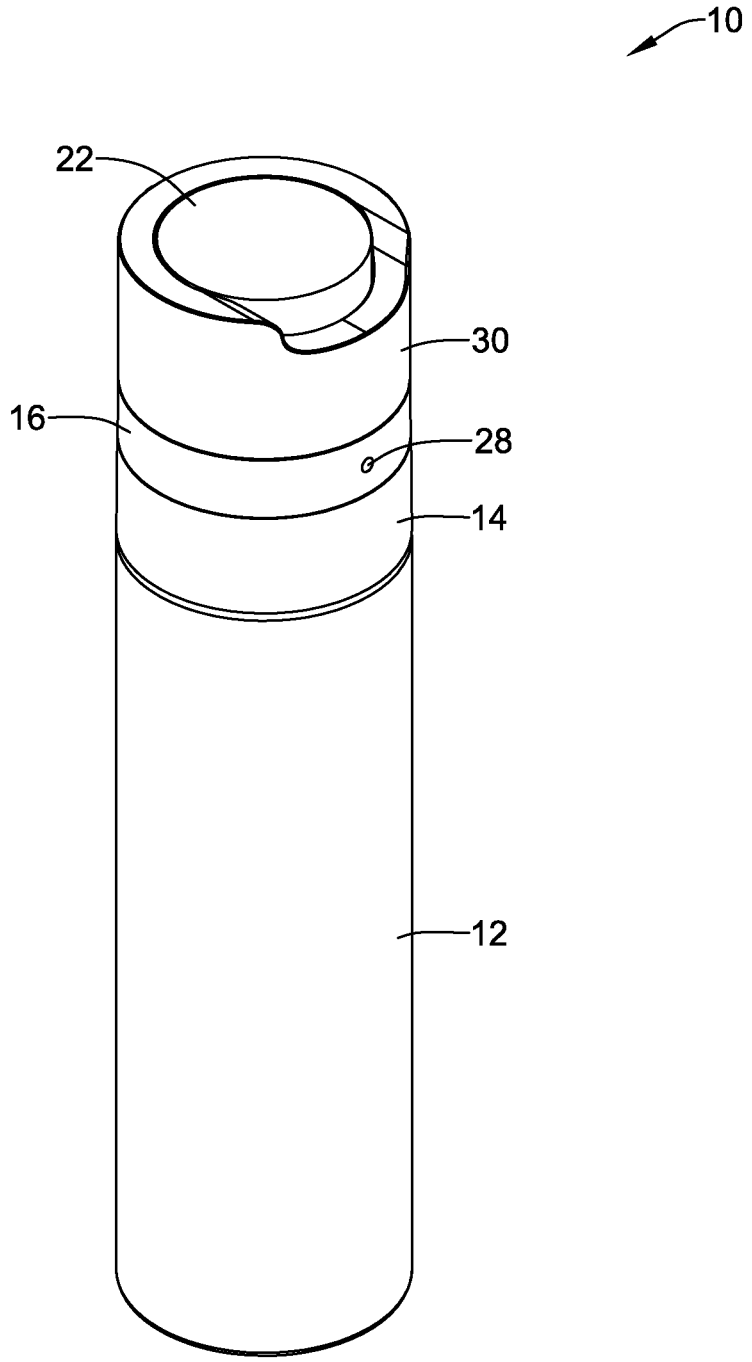
FIG. 2 is a rear perspective view of the illustrative cosmetic container of FIG. 1 in the first dispensing configuration.
Figure 4:
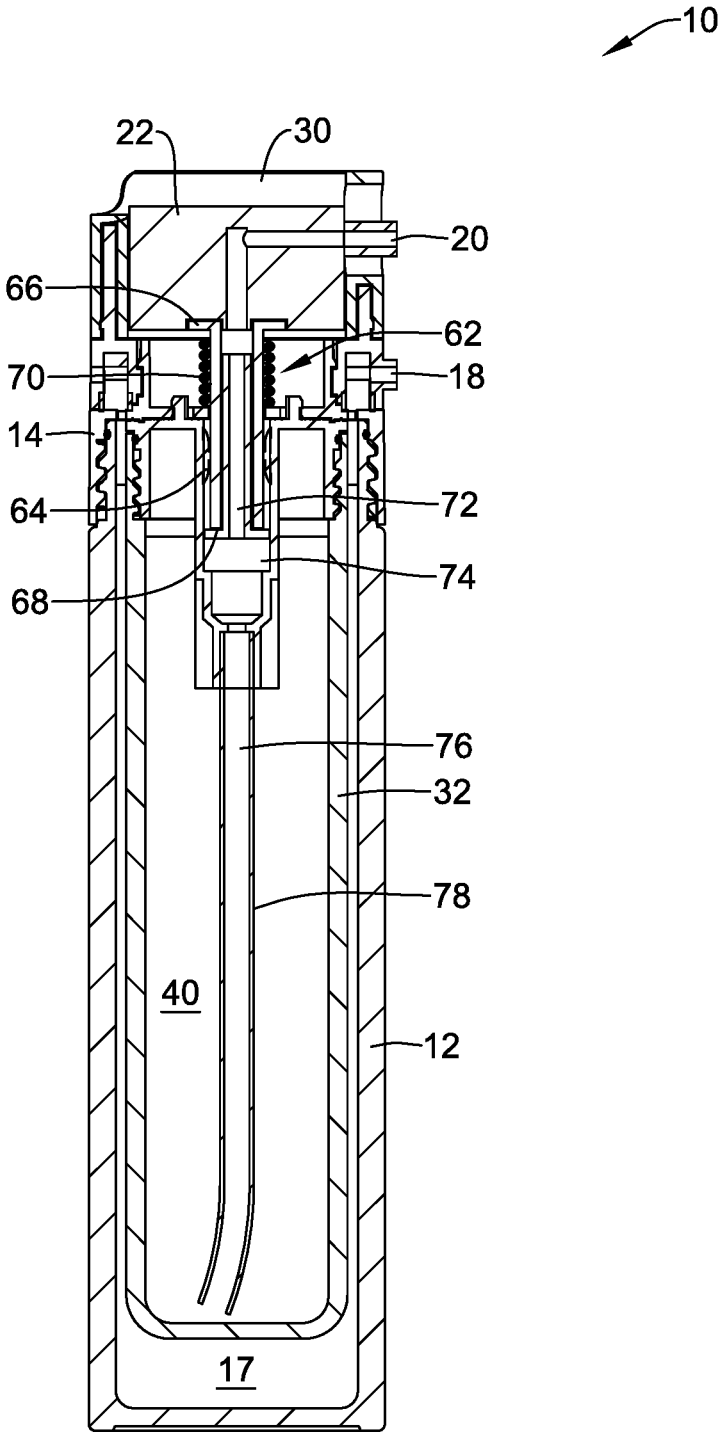
FIG. 4 is a cross-sectional view of the illustrative cosmetic container of FIG. 1 in a second dispensing configuration.

The container 10 may be movable between a closed or partially closed configuration (see, for example, FIG. 5), a first dispensing configuration, as shown in FIG. 1, and a second dispensing configuration (see, for example, FIG. 4). In the first dispensing configuration, the container 10 may be configured such that tilting the container 10 in the direction of arrow 26 allows a first pourable cosmetic to be dispensed or poured from the first dispensing outlet 18 without actuation of a pump or other mechanism. Referring additionally to FIG. 2, which illustrates a rear perspective view of the illustrative container 10, the rotatable dial 16 may also include a vent or opening 28 configured to allow air into the illustrative container 10 as the first cosmetic exits the first dispensing outlet 18. As will be described in more detail herein, the container 10 may include features which allow the first cosmetic to flow from the first dispensing outlet 18 when the container is in the first dispensing configuration and prevents flow of the first cosmetic from the first dispensing outlet 18 when the container 10 is in the closed or storage configuration as well as features which selectively block and/or expose the vent 28.

The container 10 may be moved between either of the first dispensing configuration (FIG. 1) or the partially closed configuration (FIG. 5) to the second dispensing configuration (FIG. 4) by depressing the pump actuator 22 to activate a pump mechanism to dispense a second cosmetic from the second dispensing outlet 20. The second dispensing outlet 20 may be affixed to or formed as a part of the pump actuator 22 such that the second dispensing outlet 20 is moved along an opening or slot 24 in the cap 30 as the pump actuator 22 is depressed.

Figure 3:
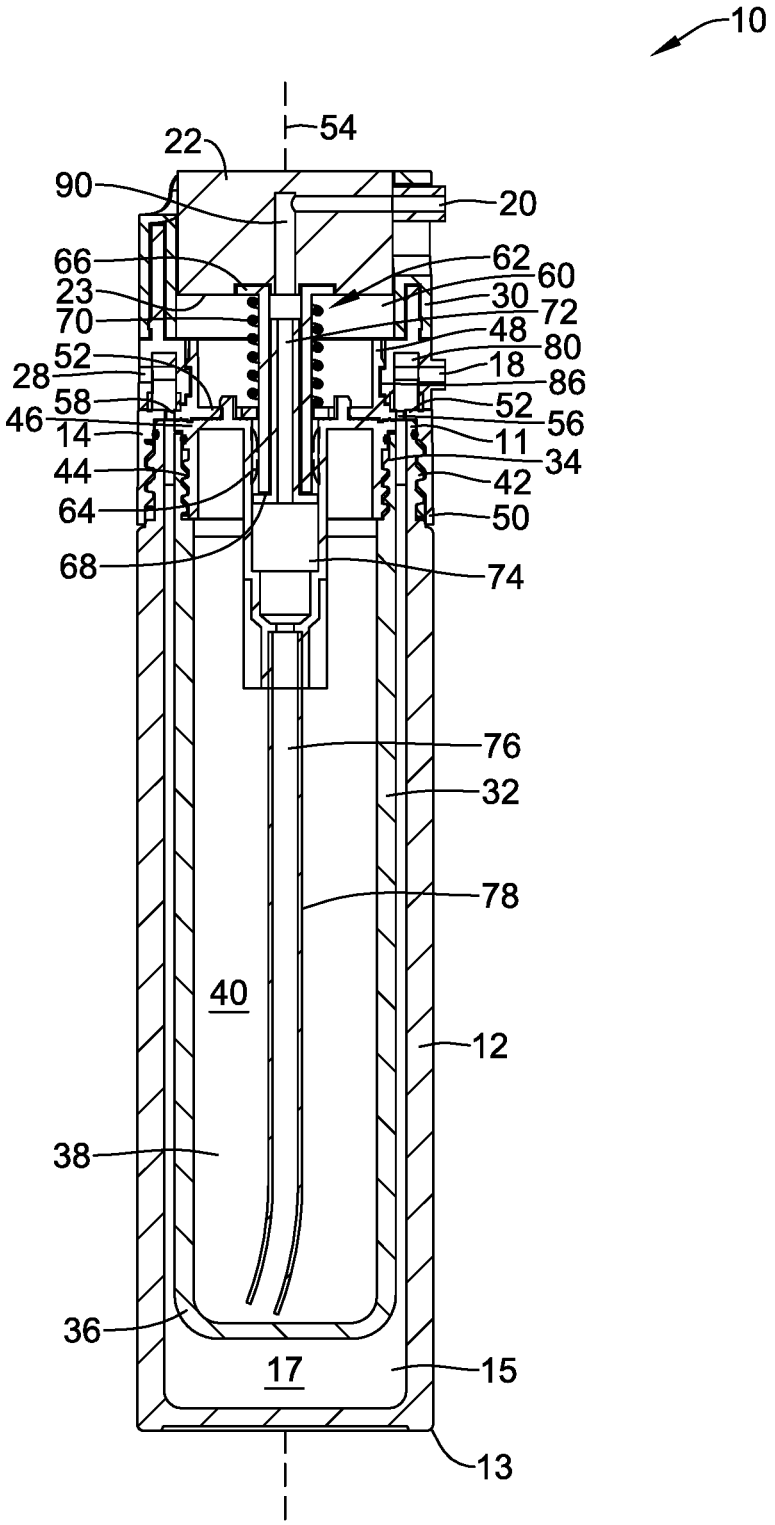
FIG. 3 is a cross-sectional view of the illustrative cosmetic container of FIG. 1, taken at line 3-3 of FIG. 1.

FIG. 3 illustrates a cross-sectional view of the cosmetic container 10 in the first dispensing configuration, taken at line 3-3 in FIG. 1. The container 10 includes an outer bottle 12 and an inner bottle 32 disposed within the outer bottle 12. The outer bottle 12 is a generally tubular component having a first end 11, a second end 13, and a cavity 15 disposed therein. The cavity 15 may be configured to hold a first cosmetic product 17 therein. The first cosmetic product 17 may have a viscosity which allows the first cosmetic product to flow through the first dispensing outlet 18 upon tilting of the container 10.

The first end 11 of the outer bottle 12 may form a neck region (for example, having a reduced outer diameter) including a threaded region 42 configured to threadably engage the outer neck 14. Other releasable coupling mechanisms can be used, as desired. It is contemplated that the outer bottle 12 may be removable. In some instances, once the cosmetic product 17 has been used, the outer bottle 12 may be removed and the cosmetic product 17 replenished or refilled to reuse the bottle. In other instances, once the cosmetic product 17 has been used, the outer bottle 12 may be removed and replaced with a new outer bottle 12 having new product 17 therein.

The inner bottle 32 is a generally tubular component having a first end 34, a second end 36, and a cavity 38 disposed therein. The cavity 38 may be configured to hold a second cosmetic product 40 therein. The first end 34 of the inner bottle 32 may form a neck region (for example, having a reduced outer diameter) including a threaded region 44 configured to threadably engage an inner neck 46 which may form a portion of a pump mechanism, although other releasable coupling mechanisms can be used as desired. It is contemplated that the inner bottle 32 may be removable. In some instances, once the cosmetic product 40 has been used, the inner bottle 32 may be removed and the cosmetic product 40 replenished or refilled to reuse the bottle. In other instances, once the cosmetic product 40 has been used, the inner bottle 32 may be removed and replaced with a new inner bottle 32 having new product 40 therein.

The outer neck 14 includes a first end region 48 having a first diameter and a second end region 50 having a second diameter greater than the first diameter. A generally planar portion 52 extending generally orthogonal to a longitudinal axis 54 is disposed between the first end region 48 and the second end region 50. The first end region 48 of the outer neck 14 may be coupled with the rotatable dial 16 via a snap fit or other coupling mechanism which allows the rotatable dial 16 to rotate relative to the outer neck 14 about the longitudinal axis 54. The second end region 50 of the outer neck 14 may threadably engage the threaded region 42 of the outer bottle 12, although other coupling mechanisms may be used, as desired.

The generally planar portion 52 of the outer neck 14 may include a first aperture 56 configured to fluidly couple the first dispensing outlet 18 and the cavity 15 of the outer bottle 12. The generally planar portion 52 of the outer neck 14 may include a second aperture 58 configured to fluidly couple the vent opening 28 and the cavity 15 of the outer bottle 12. The first and second apertures 56, 58 may be positioned radially outward to the first end region 48 of the outer neck 14. While the first dispensing outlet 18 and the vent opening 28 are illustrated as being located on opposing sides (e.g., in the range of about 180° apart), it is contemplated that the first dispensing outlet 18 and the vent opening 28 may be located at other spacing intervals, as desired. As will be described in more detail herein, the rotatable dial 16 may be rotated to close the fluid coupling between the first dispensing outlet 18 and the cavity 15 and the vent opening 28 and the cavity 15 to seal the cosmetic 17 within the outer bottle 12.

The rotatable dial 16 may also be coupled to the cap 30 via a snap fit or other coupling mechanism. In some cases, the cap 30 may be configured to rotate with the rotatable dial 16. The pump actuator 22 may be positioned within a central cavity 60 of the cap 30 and also rotatable with the rotatable dial 16. The pump actuator 22 is axially movable along the longitudinal axis 54 to activate the pump mechanism 62. The pump mechanism 62 may include a pump piston 64, a first pump stem 66, a second pump stem 68, and a spring 70, although other pump configurations may also be used. The first pump stem 66 may be coupled to or otherwise engage a bottom surface 23 of the pump actuator 22 to translate movement of the pump actuator 22 to activation of the pump mechanism 62.

The pump mechanism 62 may fluidly couple the second dispensing outlet 20 to the cavity 38 of the inner bottle 32 via a central lumen 72 of the pump mechanism 62, a lumen 74 of the inner neck 46, and a lumen 76 of a dip tube 78. The dip tube 78 may be fixedly or releasably coupled to a second end of the inner neck 46, as desired. As the pump actuator 22 is depressed (e.g., moved in a direction towards the inner bottle 32), the first pump stem 66 compress the spring and drives second pump stem 68 downwards within lumen 74 of the inner neck 46.

As the pump mechanism 62 is moved in the downwards direction, as illustrated in FIG. 4, air is first driven out of the dip tube 78 to create a suction effect which draws the cosmetic product into the lumen 76 of the dip tube 78 and out of the second dispensing outlet 20. In the illustrative embodiment of FIG. 4, the container 10 is in a second dispensing configuration in which the pump actuator 22 has been depressed to draw cosmetic 40 from the inner bottle 32 and the cosmetic 17 is capable of flowing from the outer bottle 12 if the container is tilted. While the pump mechanism 62 is described as using a dip tube, it is contemplated that the pump mechanism 62 may be replaced with an airless pump mechanism, if so desired.

Figure 5:
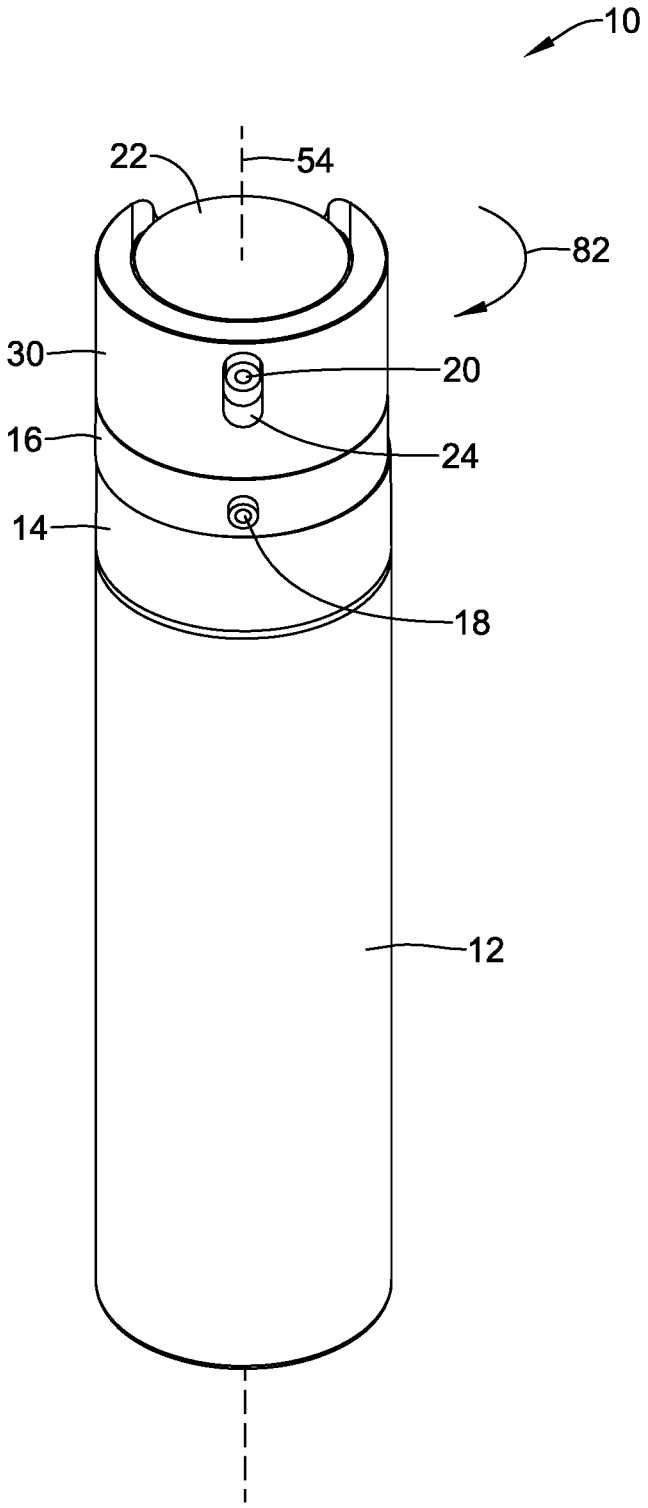
FIG. 5 is a front perspective view of the illustrative cosmetic container of FIG. 1 in a storage configuration.

FIG. 5 illustrates a front perspective view of the illustrative container 10 of FIG. 1 with the rotatable dial 16 in a closed configuration. It is contemplated that in the configuration of FIG. 5, the first cosmetic 17 may be prevented from exiting the container while the pump actuator 22 may still be activated to dispense the second cosmetic 40. However, this is not required. In some embodiments, rotation of the rotatable dial 16 may also preclude actuation of the pump actuator 22. If desired, a "click" feature may be included to hold the structure in place in one of the dispensing or closed configurations, or both.

In the illustrated embodiment of FIG. 5, the rotatable dial 16 has been rotated about the longitudinal axis 54 by in the range of about 45° to about 55° in a clockwise direction, as shown in at arrow 82, relative to the dispensing configuration illustrated in FIG. 1. However, it is contemplated that the dial 16 may be rotated by less than 45° or more than 55°, as desired, to move the first dispensing outlet 18 between a dispensing configuration and a closed configuration. It is further contemplated that the reverse configuration may also be used in which the rotatable dial 16 is rotated in a counterclockwise direction to move the first opening between a dispensing configuration and a closed configuration.

Figure 6:
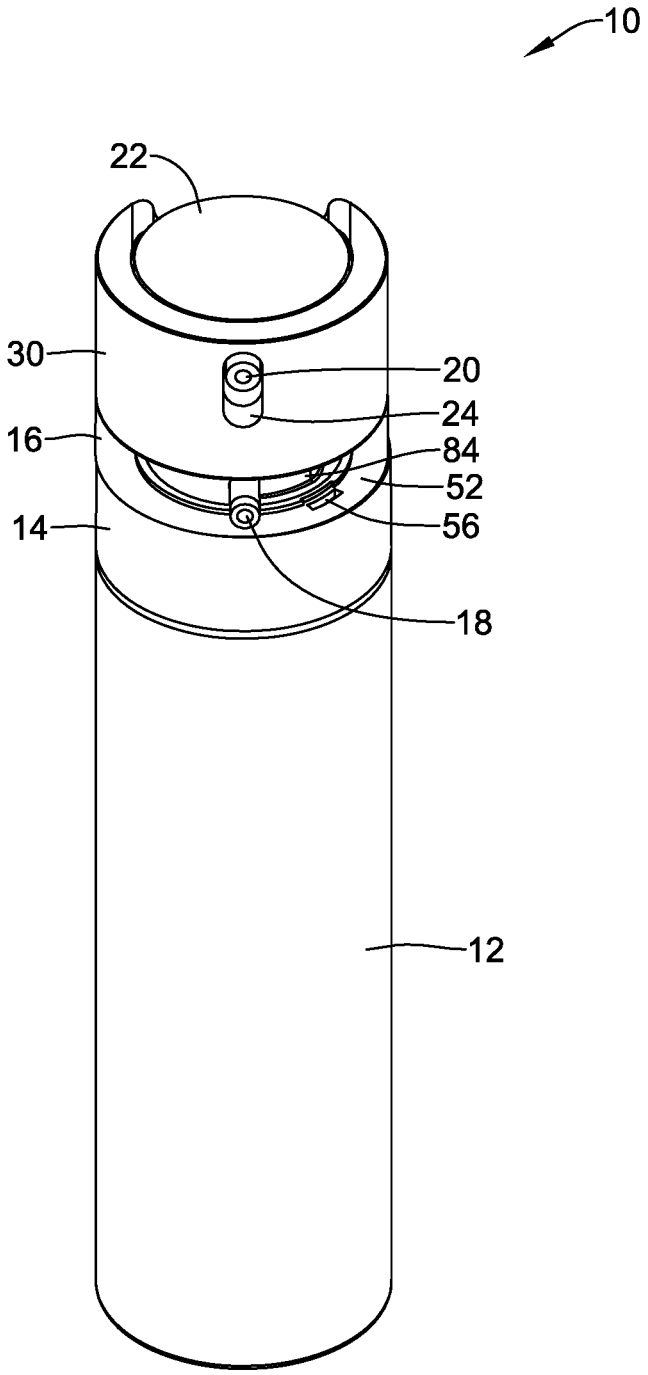
FIG. 6 is another front perspective view of the illustrative cosmetic container in the storage configuration.

FIG. 6 illustrates a front perspective view of the illustrative container 10 of FIG. 1 with the rotatable dial 16 in a closed configuration with the dial 16 and an internal gasket 80 shown in transparency to more particularly illustrate the closed configuration. As can be seen, when the dial 16 is rotated, the dial 16 and the first dispensing outlet 18 are circumferentially offset from the first opening 56 in the generally planar portion 52 of the outer neck 14. As the dial 16 is rotated, the internal gasket 80 is also rotated such that a solid portion of the internal gasket 80 is disposed over the first opening 56 in the generally planar portion 52 of the outer neck 14 fluidly isolating the first dispensing outlet 18 in the dial 16 from the cavity 15 of the outer bottle 12. In this configuration, the first cosmetic 17 is prevented from being disposed from the outer bottle 12.

It is further contemplated that the first end region 48 of the outer neck 14 may be provided with a slot 84 configured to receive a radially inward extending protrusion 86 (see, for example, FIG. 3 or FIG. 8) on the rotatable dial 16. The slot 84 and protrusion 86 may cooperate to provide a mechanical stop which provides a tactile sensation to the user when the dial 16 is in the fully closed (FIG. 5 or 6) or fully open configuration (FIG. 1). In some cases, an outer surface of the container 10 may be provided with indicia configured to provide a visual indication of the open or closed status of at least the first dispensing outlet 18.

Figure 7:
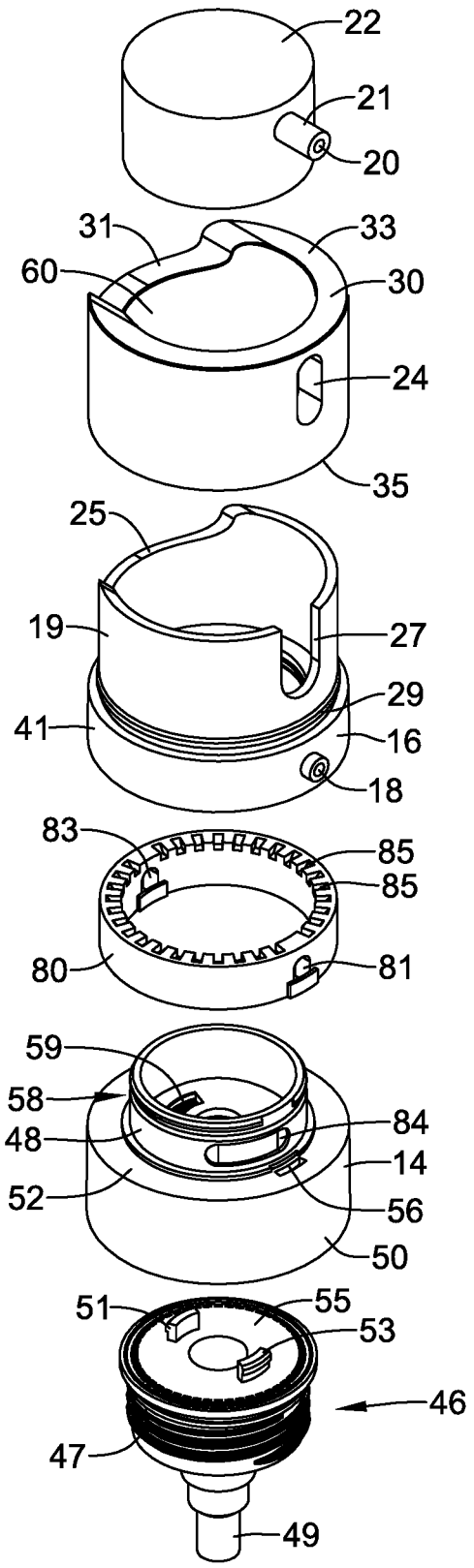
FIG. 7 is an exploded top perspective view of the dispensing assembly of the illustrative cosmetic container of FIG. 1.
Figure 8:
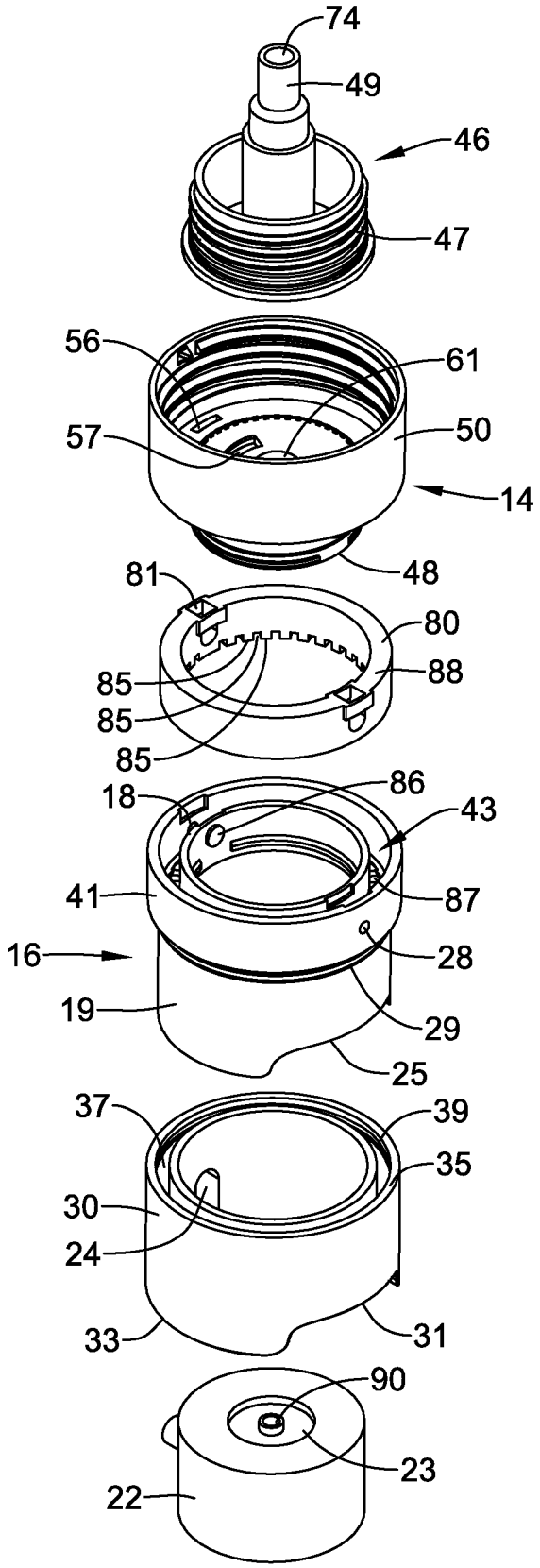
FIG. 8 is an exploded bottom perspective view of the dispensing assembly of the illustrative cosmetic container of FIG. 1.

FIG. 7 illustrates an exploded perspective top view of a portion of the illustrative cosmetic applicator of FIG. 1 and FIG. 8 illustrates an exploded perspective bottom view of a portion of the illustrative cosmetic applicator of FIG. 1. As described above, the pump actuator 22 may be slidably disposed within a central cavity 60 of the cap 30. In some cases, a nozzle 21 may be fixedly or removably coupled to the pump actuator 22 after the pump actuator 22 has been positioned within the cavity of the cap 30. The nozzle 21 may fluidly couple the second dispensing outlet 20 with a lumen 90 of the pump actuator 22, which in turn is fluidly coupled to the pump mechanism 62. When assembled, the nozzle 21 may extend through a slot 24 in the cap 30. The slot may allow the pump actuator 22 and the nozzle 21 to move axially along the longitudinal axis of the container 10 while limiting rotational movement thereof. In some cases, the cap 30 may include a recess or cut out 31 adjacent the first end 33 thereof. The recess 31 may be configured to allow a user to grip and depress the pump actuator 22 with a single hand, although this is not required.

The cap 30 may further include an annular recess 37 extending from the bottom, or second, end 35 towards the top or first end 33. The annular recess 37 may terminate proximal to the first end 33 such that the annular recess does not extend over the entire length of the cap 30. The annular recess 37 may be configured to receive a first end region 19 of the rotatable dial 16. The first end region 19 of the rotatable dial 16 may have a shape similar to that of the cap 30. For example, the first end region 19 of the dial 16 may include a recess or cut out 25 similar in size and shape of the recess 31 of the cap 30. The first end region 19 of the dial 16 may also include a longitudinally extending slot 27 configured to slidably receive the nozzle 21. During assembly, the slot 27 of the dial 16 may be aligned with the slot 24 of the cap 30.

The rotatable dial 16 may further include a radially outward extending protrusion 29 configured to form a snap fit with a mating recess or groove 39 within the annular recess 37 of the cap 30. The rotatable dial 16 may further include a second end region 41 having a diameter greater than a diameter of the first end region 19. The first dispensing outlet 18 may extend through a wall of the second end region 41 of the dial 16. In some embodiments, the first outlet 18 may take the shape of a cylindrical nozzle, although this is not required. The second end region 41 of the dial 16 further defines an annular cavity 43 configured to receive the flexible gasket 80. The gasket 80 may include a first curved or "L" shaped channel 81 configured to fluidly couple the cavity 15 of the outer bottle 12 with the first dispensing outlet 18 in the dial 16 and a second curved or "L" shaped channel 83 configured to fluidly couple the cavity 15 of the outer bottle 12 with the vent opening 28 in the dial 16. The gasket 80 may be formed from a deformable, soft material with the dial 16 over-molded thereon.

The gasket 80 may further include a plurality of grooves and recesses 85 configured to mate with a plurality of grooves and recesses 87 within the annular cavity 43 of the dial 16. The grooves and recesses 85, 87 may form a mechanical interlock that causes the gasket 80 to rotate with the dial 16. As described above, the dial 16 and gasket 80 may be rotated to selectively fluidly couple the cavity of the outer bottle 12 with the first dispensing outlet 18 and vent opening 28 of the dial 16 via the first and second channels 81, 83 of the gasket 80, respectively. For example, when the first and second channels 81, 83 of the gasket 80 align with the first and second apertures 56, 58 in the generally planar portion 52 of the outer neck 14, the cavity 15 of the outer bottle 12 is fluidly coupled with the first outlet 18 and the vent opening 28 and cosmetic 17 may be poured from the first dispensing outlet 18 upon tilting of the container 10. When the first and second channels 81, 83 of the gasket 80 are offset from (e.g., rotated away from) the first and second apertures 56, 58 in the generally planar portion 52 of the outer neck 14, the solid bottom surface 88 of the gasket 80 prevents or blocks the first cosmetic 17 from exiting the outer bottle 12.

As described above, the dial 16 may further include a radially inward extending protrusion 86. The protrusion 86 may be configured to be received within a slot 84 in the first end region 48 of the outer neck 14. The slot 84 may be sized and shaped to limit rotational movement of the dial 16 relative to the outer neck 14. In some embodiments, the second end region 41 of the dial 16 may be configured to form a snap fit with the first end region 48 of the outer neck 14 in addition to the engagement between the protrusion 86 and the slot 84, although this is not required.

The inner neck 46 includes a first end region 47 having a first diameter and a second end region 49 having a second diameter less than the first diameter. The first end region 47 may include external threads configured to threadably engage the threaded region 44 of the inner bottle 32. A central lumen 74 may extend an entire length of the inner neck 46 from the first end region 47 to the second end region 49. A portion of the lumen 74 adjacent to the first end region 47 may be configured to receive at least a portion of the pump mechanism 62 (see, for example, FIGS. 3 and 4). For example, the pump mechanism 62 may extend from the bottom surface 23 (which may be sized and shaped to receive the first pump stem 66) through a central aperture 61 in the outer neck 14 and into the lumen 74 of the inner neck 46. A first end of the dip tube 78 may be disposed within the lumen 74 adjacent to the second end region 49 of the inner neck 46.

The inner neck 46 may include a generally planar top surface 55. A first angled leg 51 and a second angled leg 53 may extend away from the planar top surface 55 (e.g., in a direction towards the pump actuator 22. The angled legs 51, 53 may be configured to be received within a pair of apertures 57, 59 formed in the generally planar portion 52 of the outer neck 14. The pair of apertures 57, 59 may be positioned radially inward to the first end region 48 of the outer neck 14. The legs 51, 53 and apertures 57, 59 may be sized and shaped such that the angle of the legs 51, 53 prevents the inner neck 46 from decoupling from the outer neck 14.

Figure 9:
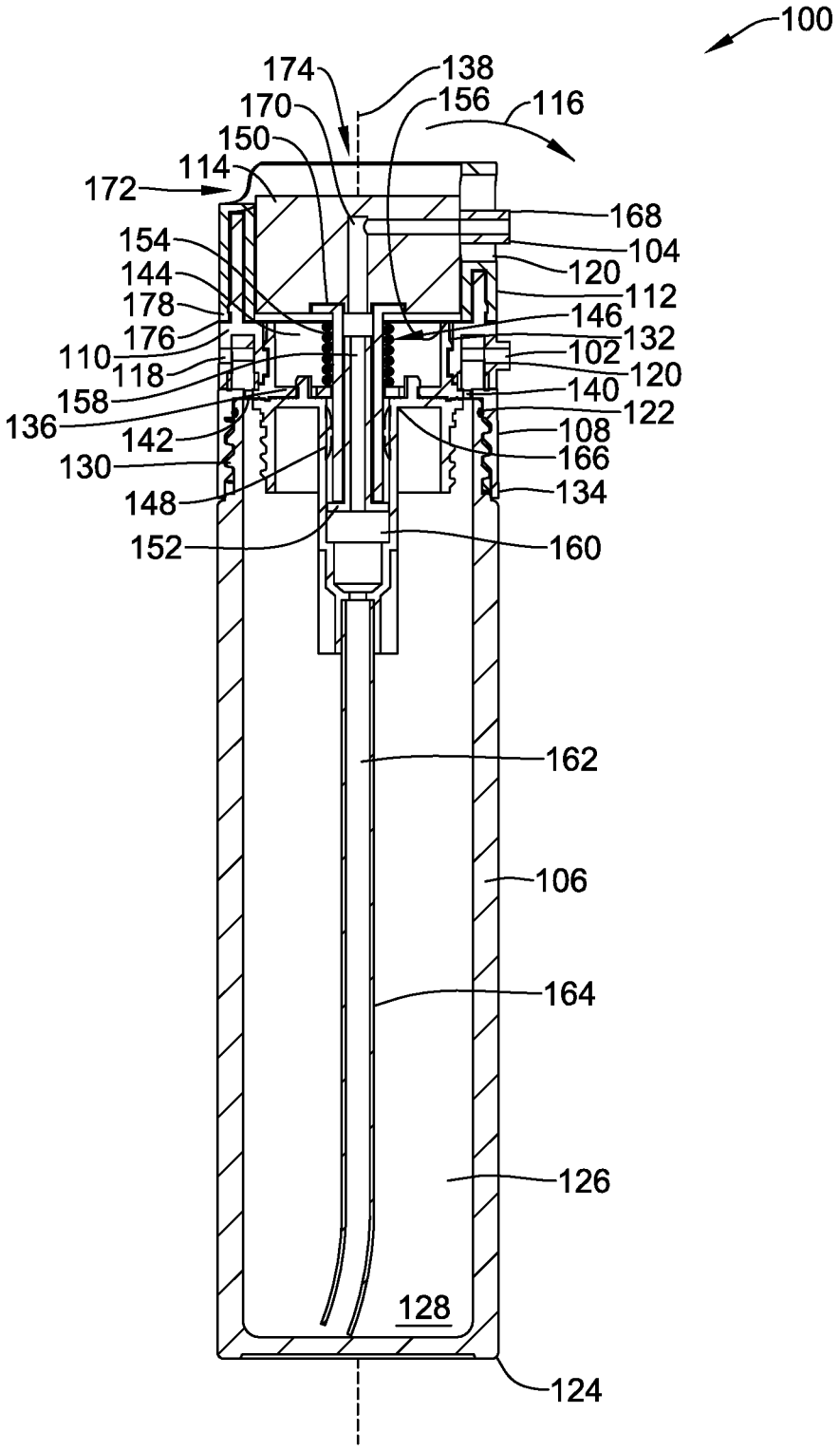
FIG. 9 is a cross-sectional view of another illustrative cosmetic container.

FIG. 9 is a cross-sectional view of another illustrative container 100 for dispensing a cosmetic product via a first dispensing outlet 102 and a second dispensing outlet 104. The container 100 may be similar in form and function to the container 10 described herein. However, in container 100, the inner bottle 32 of container 10 is not present. The container 100 include a bottle 106, an outer neck 108, a rotatable dial 110 including the first dispensing outlet 102, a cap 112, and a pump actuator 114 including the second dispensing outlet 104. In the cosmetics and personal care industries, the cosmetic container 100 may be used to dispense liquid foundations, creams, lotions, oils, serums, lip gloss, etc. By way of example, and not limitation, the cosmetic container 100 can also be used in applications other than cosmetic devices. For example, the cosmetic container 100 may be implemented in medicinal products, cosmetics and personal care industries or other industries for applying a liquid or gel product.

The container 100 for dispensing a cosmetic product is shown in an elongated cylindrical configuration. However, it should be understood that examples of the disclosure described herein may be applied to various other configurations in other examples. For example, the container 100 may alternatively be embodied in an elongated square or polygonal configuration where the components of the device are all of such shapes. Other shapes include oval, triangular, heart shaped, etc.

While not explicitly shown, the cosmetic container 100 may include an optional removable lid releasably coupled to the outer neck 108 and/or bottle 106. The lid may be configured to prevent unintentional actuation of the pump actuator 114 during storage or transport of the cosmetic container 100. In some cases, the lid may include features (e.g., a protrusion) configured to form a snap fit with a mating groove or recess on the outer neck 108 and/or bottle 106. In other cases, the lid may be configured to threadably engage, form an interference fit with, or otherwise couple with the outer neck 108 and/or bottle 106.

The container 100 may be movable between a closed or partially closed configuration, a first dispensing configuration, and a second dispensing configuration in a similar manner to the container 10 described above. In the first dispensing configuration, the container 100 may be configured such that tilting the container 100 in the direction of arrow 116 allows a cosmetic product to be dispensed or poured from the first dispensing outlet 102 without actuation of a pump or other mechanism. The rotatable dial 110 may also include a vent or opening 118 configured to allow air into the illustrative container 100 as the cosmetic product exits the first dispensing outlet 102. As will be described in more detail herein, the container 100 may include features which allow the cosmetic product to flow from the first dispensing outlet 102 when the container is in the first dispensing configuration and prevents flow of the cosmetic product from the first dispensing outlet 102 when the container 100 is in the closed or storage configuration as well as features which selectively block and/or expose the vent 118.

The container 100 may be moved between either of the first dispensing configuration or the partially closed configuration to the second dispensing configuration by depressing the pump actuator 114 to activate a pump mechanism to dispense the cosmetic product from the second dispensing outlet 104 (as shown in FIG. 9). The second dispensing outlet 104 may be affixed to or formed as a part of the pump actuator 114 such that the second dispensing outlet 104 is moved along an opening or slot 120 in the cap 112 as the pump actuator 114 is depressed.

FIG. 9 illustrates a cross-sectional view of the cosmetic container 100 in the second dispensing configuration. The bottle 106 is a generally tubular component having a first end 122, a second end 124, and a cavity 126 disposed therein. The cavity 126 may be configured to hold a cosmetic product 128 therein. The cosmetic product 128 may have a viscosity which allows the cosmetic product 128 to flow through the first dispensing outlet 102 upon tilting of the container 100.

The first end 122 of the bottle 106 may form a neck region (for example, having a reduced outer diameter) including a threaded region 130 configured to threadably engage the outer neck 108. Other releasable coupling mechanisms can be used, as desired. It is contemplated that the bottle 106 may be removable. In some instances, once the cosmetic product 128 has been used, the bottle 106 may be removed and the cosmetic product 128 replenished or refilled to reuse the bottle. In other instances, once the cosmetic product 128 has been used, the bottle 106 may be removed and replaced with a new bottle 106 having new product 128 therein.

The outer neck 108 includes a first end region 132 having a first diameter and a second end region 134 having a second diameter greater than the first diameter. A generally planar portion 136 extending generally orthogonal to a longitudinal axis 138 is disposed between the first end region 132 and the second end region 134. The first end region 132 of the outer neck 108 may be coupled with the rotatable dial 110 via a snap fit or other coupling mechanism which allows the rotatable dial 110 to rotate relative to the outer neck 108 about the longitudinal axis 138. The second end region 134 of the outer neck 108 may threadably engage the threaded region 130 of the bottle 106, although other coupling mechanisms may be used, as desired.

The generally planar portion 136 of the outer neck 108 may include a first aperture 140 configured to fluidly couple the first dispensing outlet 102 and the cavity 126 of the bottle 106. The generally planar portion 136 of the outer neck 108 may include a second aperture 142 configured to fluidly couple the vent opening 118 and the cavity 126 of the bottle 106. The first and second apertures 140, 142 may be positioned radially outward to the first end region 132 of the outer neck 108. While the first dispensing outlet 102 and the vent opening 118 are illustrated as being located on opposing sides (e.g., in the range of about 180° apart), it is contemplated that the first dispensing outlet 102 and the vent opening 118 may be located at other spacing intervals, as desired. As will be described in more detail herein, the rotatable dial 110 may be rotated to close the fluid coupling between the first dispensing outlet 102 and the cavity 126 and the vent opening 118 and the cavity 126 to seal the cosmetic 128 within the bottle 106.

The rotatable dial 110 may also be coupled to the cap 112 via a snap fit or other coupling mechanism. In some cases, the cap 112 may be configured to rotate with the rotatable dial 110. The pump actuator 114 may be positioned within a central cavity 144 of the cap 112 and also rotatable with the rotatable dial 110. The pump actuator 114 is axially movable along the longitudinal axis 138 to activate the pump mechanism 146. The pump mechanism 146 may include a pump piston 148, a first pump stem 150, a second pump stem 152, and a spring 154, although other pump configurations may also be used. The first pump stem 150 may be coupled to or otherwise engage a bottom surface 156 of the pump actuator 114 to translate movement of the pump actuator 114 to activation of the pump mechanism 146.

The pump mechanism 146 may fluidly couple the second dispensing outlet 104 to the cavity 126 of the bottle 106 via a central lumen 158 of the pump mechanism 146, a lumen 160 of an inner neck 166, and a lumen 162 of a dip tube 164. The dip tube 164 may be fixedly or releasably coupled to a second end of the inner neck 166, as desired. As the pump actuator 114 is depressed (e.g., moved in a direction towards the inner bottle 106), the first pump stem 150 compress the spring and drives second pump stem 152 downwards within lumen 160 of the inner neck 166.

As the pump mechanism 146 is moved in the downwards direction, as illustrated in FIG. 9, air is first driven out of the dip tube 164 to create a suction effect which draws the cosmetic product into the lumen 162 of the dip tube 164 and out of the second dispensing outlet 104. In the illustrative embodiment of FIG. 9, the container 100 is in a second dispensing configuration in which the pump actuator 114 has been depressed to draw cosmetic 128 from the bottle 106 and the cosmetic 128 is also capable of flowing from the bottle 106 if the container is tilted. While the pump mechanism 146 is described as using a dip tube, it is contemplated that the pump mechanism 146 may be replaced with an airless pump mechanism, if so desired.

While not explicitly shown, the rotatable dial 110 may be rotated (in a similar manner as described above with respect to container 10) such that the openings 140, 142 are blocked or sealed. For example, when the dial 110 is rotated, the dial 110 and the first dispensing outlet 102 are circumferentially offset from the first opening 140 in the generally planar portion 136 of the outer neck 108. In such a configuration, the cosmetic 128 may be prevented from exiting the container 100 while the pump actuator 114 may still be activated to dispense the cosmetic 128. However, this is not required. In some embodiments, rotation of the rotatable dial 110 may also preclude actuation of the pump actuator 114. If desired, a "click" feature may be included to hold the structure in place in one of the dispensing or closed configurations, or both.

While not explicitly shown, the first end region 132 of the outer neck 108 may be provided with a slot configured to receive a radially inward extending protrusion (as described above with respect to container 10) on the rotatable dial 110. The slot and protrusion may cooperate to provide a mechanical stop which provides a tactile sensation to the user when the dial 110 is in the fully closed (not explicitly shown) or fully open configuration (FIG. 9). In some cases, an outer surface of the container 100 may be provided with indicia configured to provide a visual indication of the open or closed status of at least the first dispensing outlet 102.

As described above, the pump actuator 114 may be slidably disposed within a central cavity 144 of the cap 112. In some cases, a nozzle 168 may be fixedly or removably coupled to the pump actuator 114 after the pump actuator 114 has been positioned within the cavity of the cap 112. The nozzle 168 may fluidly couple the second dispensing outlet 104 with a lumen 170 of the pump actuator 114, which in turn is fluidly coupled to the pump mechanism 146. When assembled, the nozzle 168 may extend through a slot 120 in the cap 112. The slot 120 may allow the pump actuator 114 and the nozzle 168 to move axially along the longitudinal axis of the container 100 while limiting rotational movement thereof. In some cases, the cap 112 may include a recess or cut out 172 adjacent the first end 174 thereof. The recess 172 may be configured to allow a user to grip and depress the pump actuator 114 with a single hand, although this is not required.

The cap 112 may further include an annular recess 178 extending from the bottom, or second, end 176 towards the top or first end 174. The annular recess 178 may terminate proximal to the first end 174 such that the annular recess 178 does not extend over the entire length of the cap 112. The annular recess 178 may be configured to receive a first end region of the rotatable dial 110. The first end region of the rotatable dial 110 may have a shape similar to that of the cap 112. For example, the first end region of the dial 110 may include a recess or cut out similar in size and shape of the recess 172 of the cap 112. The first end region of the dial 110 may also include a longitudinally extending slot configured to slidably receive the nozzle 168. During assembly, the slot of the dial 110 may be aligned with the slot 120 of the cap 112.

The rotatable dial 110 may be configured to form a snap fit with a mating recess or groove within the annular recess 178 of the cap 112 in a similar manner to that described above with respect to container 10. The rotatable dial 110 may further include a second end region having a diameter greater than a diameter of the first end region. The first dispensing outlet 102 may extend through a wall of the second end region of the dial 110. In some embodiments, the first outlet 102 may take the shape of a cylindrical nozzle, although this is not required. The second end region of the dial 110 further defines an annular cavity configured to receive a flexible gasket. The gasket may include a first curved or "L" shaped channel configured to fluidly couple the cavity 126 of the bottle 106 with the first dispensing outlet 102 in the dial 110 and a second curved or "L" shaped channel configured to fluidly couple the cavity 126 of the bottle 106 with the vent opening 118 in the dial 110, as shown and described above with respect to container 10. The gasket may be formed from a deformable, soft material with the dial 110 over-molded thereon and structured in a similar manner to the gasket 80 described above.

As described above, the dial 110 may further include a radially inward extending protrusion configured to be received within a slot in the first end region 132 of the outer neck 108. The slot may be sized and shaped to limit rotational movement of the dial 110 relative to the outer neck 108. In some embodiments, the second end region of the dial 110 may be configured to form a snap fit with the first end region 132 of the outer neck 108 in addition to the engagement between the protrusion and the slot, although this is not required.

The inner neck 166 includes a first end region having a first diameter and a second end region having a second diameter less than the first diameter. A central lumen 160 may extend an entire length of the inner neck 166 from the first end region to the second end region. A portion of the lumen 160 adjacent to the first end region may be configured to receive at least a portion of the pump mechanism 146. For example, the pump mechanism 146 may extend from the bottom surface 156 (which may be sized and shaped to receive the first pump stem 150) through a central aperture in the outer neck 108 and into the lumen 160 of the inner neck 166. A first end of the dip tube 164 may be disposed within the lumen 160 adjacent to the second end region 49 of the inner neck 166. The inner neck 166 may form a snap fit with the outer neck 108 in a manner similar to that described above with respect to the container 10.

In some embodiments, the cosmetic containers 10, 100, and/or the various components thereof, may be made from a rigid material (e.g., acrylonitrile butadiene styrene, polypropylene (PP), polyoxymethylene (POM)), thermoplastics, other polymers, glass, ceramic, stone, metal, alloy, wood, and the like). Other embodiments may, however, include containers 10 and/or various components thereof, made from a flexible or semi-rigid material, such as rubber, low density polyethylene (LDPE), thermoplastic elastomers (TPE), silicone, plastic (e.g. polypropylene (PP)), other plastics or polymers, etc. In some embodiments, the container 10, or portions thereof, may comprise a transparent or translucent material so that the cosmetic product within may be externally viewed.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A cosmetic container, comprising:

an outer bottle defining a first cavity configured to receive a first cosmetic product;

an inner bottle disposed within the first cavity of the outer bottle and defining a second cavity configured to receive a second cosmetic product;

an outer neck coupled to a first end region of the outer bottle;

an inner neck coupled to a first end region of the inner bottle;

a rotatable dial defining a first dispensing outlet rotatably coupled to the outer neck;

a pump actuator defining a second dispensing outlet and slidably disposed within a cap, the cap coupled to the rotatable dial; and a pump mechanism fluidly coupled to the second dispensing outlet and the second cavity;

wherein the rotatable dial is movable between a first dispensing configuration and a second storage configuration to selectively fluidly couple the first cavity and the first dispensing outlet.

2. The cosmetic container of claim 1, wherein actuation of the pump mechanism dispenses the second cosmetic product through the second dispensing outlet.

3. The cosmetic container claim 1, wherein when the rotatable dial is in the first dispensing configuration, the first cosmetic product is pourable from the first dispensing outlet.

4. The cosmetic container claim 1, further comprising a flexible gasket disposed within an annular cavity of the rotatable dial.

5. The cosmetic container of claim 4, wherein the flexible gasket includes a first channel configured to fluidly couple the first cavity with the first dispensing outlet.

6. The cosmetic container of claim 5, wherein the flexible gasket includes a second channel configured to fluidly couple the first cavity with a vent opening.

7. The cosmetic container of claim 4, wherein when the rotatable dial is in the second storage configuration, the gasket is configured to fluidly isolate the first dispensing outlet from the first cavity.

8. The cosmetic container of claim 1, wherein the second dispensing outlet comprises a cylindrical nozzle.

9. The cosmetic container of claim 8, wherein the cylindrical nozzle is axially slidable within a slot extending through a wall of the cap.

10. The cosmetic container of claim 1, wherein the rotatable dial further comprises a radially inward extending protrusion, the radially inward extending protrusion configured to engage a slot in the outer neck.

11. The cosmetic container of claim 10, wherein the radially inwardly extending protrusion and the slot are configured to limit a rotational range of motion of the rotatable dial.

12. The cosmetic container of claim 11, wherein the rotational range of motion is in a range of about 45° to about 55°.

13. The cosmetic container of claim 1, wherein the pump mechanism is actuatable when the rotatable dial is in the first dispensing configuration and when the rotatable dial is in the second storage configuration.

14. A cosmetic container, comprising:

an outer bottle defining a first cavity configured to receive a first cosmetic product;

an inner bottle disposed within the first cavity of the outer bottle and defining a second cavity configured to receive a second cosmetic product;

an outer neck coupled to a first end region of the outer bottle;

a rotatable dial defining a first dispensing outlet rotatably coupled to the outer neck;

a vent opening defined in the rotatable dial;

a pump actuator defining a second dispensing outlet and slidably disposed within a cap, the cap coupled to the rotatable dial; and a pump mechanism fluidly coupled to the second dispensing outlet and the second cavity;

wherein the rotatable dial is movable between a first dispensing configuration and a second storage configuration to selectively fluidly couple the first cavity and the first dispensing outlet.

15. The cosmetic container of claim 14, wherein when the rotatable dial is in the first dispensing configuration, the vent opening is in fluid communication with the first cavity.

16. The cosmetic container of claim 14, wherein the second dispensing outlet is axially slidable within a slot extending through a wall of the cap.

17. The cosmetic container of claim 14, further comprising a flexible gasket disposed within an annular cavity of the rotatable dial.

18. The cosmetic container of claim 17, wherein the flexible gasket includes a first channel configured to fluidly couple the first cavity with the first dispensing outlet and a second channel configured to fluidly couple the first cavity with the vent opening.

19. The cosmetic container of claim 17, wherein when the rotatable dial is in the second storage configuration, the flexible gasket is configured to fluidly isolate the first dispensing outlet from the first cavity.

20. A cosmetic container, comprising:

a bottle defining a cavity configured to receive a cosmetic product;

an outer neck coupled to a first end region of the bottle;

a rotatable dial defining a first dispensing outlet rotatably coupled to the outer neck;

a vent opening defined in the rotatable dial;

a pump actuator defining a second dispensing outlet and slidably disposed within a cap, the cap coupled to the rotatable dial; and a pump mechanism fluidly coupled to the second dispensing outlet and the cavity;

wherein the rotatable dial is movable between a first dispensing configuration and a second storage configuration to selectively fluidly couple the cavity and the first dispensing outlet; and wherein the pump mechanism is actuatable when the rotatable dial is in the first dispensing configuration and when the rotatable dial is in the second storage configuration.

* * * * *